United States Patent [19]

Jacobsson et al.

[11] Patent Number: 4,986,465

[45] Date of Patent: Jan. 22, 1991

[54] OPENING ARRANGEMENT ON A PACKING CONTAINER

[75] Inventors: Kent Jacobsson, Södra Sandby; Hans Carlsson, Nyköping, both of Sweden

[73] Assignee: Tetra Park Holdings & Finance S.A., Pully, Switzerland

[21] Appl. No.: 435,248

[22] Filed: Nov. 9, 1989

[30] Foreign Application Priority Data

Nov. 9, 1988 [SE] Sweden ..... 88040415

[51] Int. Cl.[5] ..... B65D 5/70

[52] U.S. Cl. ..... 229/123.3; 220/269; 229/125.09; 229/125.14

[58] Field of Search ..... 229/123.2, 123.3, 125.09, 229/125.14, 125.14; 220/268, 269, 270

[56] References Cited

U.S. PATENT DOCUMENTS

| | | | |
|---|---|---|---|
| 2,023,151 | 12/1935 | Sebell | 220/269 |
| 3,127,082 | 3/1964 | Meyer-Jagenberg | 229/123.3 |
| 3,166,226 | 1/1965 | Mobley | 229/125.15 |
| 3,355,059 | 11/1967 | Balocca et al. | 229/123.2 |
| 3,658,238 | 4/1972 | Nedstedt . | |
| 3,774,662 | 11/1973 | Neville et al. . | |
| 3,883,034 | 5/1975 | Rausing . | |
| 3,977,591 | 8/1976 | Martensson . | |
| 3,990,603 | 11/1976 | Brochman | 229/125.09 |
| 3,998,354 | 12/1976 | Song . | |
| 4,113,103 | 9/1978 | Carlsson . | |
| 4,126,263 | 11/1978 | Martenson . | |
| 4,197,949 | 4/1980 | Carlsson . | |
| 4,258,876 | 3/1981 | Ljungcrantz . | |
| 4,359,169 | 11/1982 | Helms et al. | 229/125.14 |
| 4,391,385 | 7/1983 | Rausing | 220/269 |
| 4,730,769 | 3/1988 | Stark | 229/125.15 |
| 4,735,336 | 4/1988 | Buchner et al. | 220/270 |
| 4,781,323 | 11/1988 | Elias et al. | 229/125.15 |
| 4,782,646 | 11/1988 | Nantin . | |
| 4,930,683 | 6/1990 | Farber | 229/125.15 |

*Primary Examiner*—Gary E. Elkins

*Attorney, Agent, or Firm*—Burns, Doane, Swecker & Mathis

[57] ABSTRACT

An opening arrangement for a packing container includes a flexible strip having first and second parts which are connected to one another by a flexible intermediate piece. The first part of the strip has a downwardly projecting portion that fits within the hole in the packing container. The first part includes an openable part for preventing the contents from being emptied from the container until the openable part has been torn away. The second part of the strip is somewhat cup-shaped and includes a bottom surface that is sealed to the openable part of the first part so that when the cup-shaped second part of the strip is pulled backwards, the openable part will be torn away, thereby forming a pouring opening.

13 Claims, 1 Drawing Sheet

OPENING ARRANGEMENT ON A PACKING CONTAINER

The present invention relates to an opening arrangement and more particularly, an opening arrangement for attachment to—a packing container.

BACKGROUND OF THE INVENTION

In packing technology finished consumer packages of non-returnable character which are manufactured from a material consisting of a carrier layer of cardboard or paper and outer and inner coatings of thermoplastics have been used for a long time. Material in these so-called non-returnable packages is often also provided with one or more layers of other material, e.g. aluminum foil or plastic layers of a different type than those mentioned here.

The composition of the packing material is selected to create the best possible protection for the product which is to be packed, while at the same time providing the package with sufficient mechanical strength to make possible a comfortable handling of the package. To achieve the required mechanical strength which affords protection for the contents and makes it possible for the package to be sufficiently rigid in its dimensions so that it can be handled and manually gripped without difficulty, the material in packages of this type is frequently provided with a relatively thick carrier layer of paper or cardboard. Such a carrier layer, however, is not airtight with respect to gases or liquids and the rigidity of the material is quickly lost when it is subjected to moisture or liquid. To impart to the material a good liquid tightness a thin coating of plastic material is provided, and, if the plastic material is a thermoplastics, it may also be used for sealing the plastic layers to one another by means of heat and pressure (so-called heat-sealing). Thus a packing container can be sealed and made permanent in its given shape by heat-sealing overlapping, thermoplastic material panels to one another in a tight and mechanically durable seal.

Non-returnable packages of the type described above are manufactured either from blanks punched out beforehand or from a continuous web which has been prepared with suitable decoration and with a pattern of crease lines facilitating the formation of folds. Packing containers are manufactured from a web by joining to one another longitudinal edges of the web in an overlap joint, so as to form a tube which subsequently is filled with the intended contents and is divided into closed cushionlike container units through repeated flattenings and transverse sealings of the tube at right angles to the longitudinal axis of the tube. Through appropriate fold-forming of the packing material in the tube the container units are converted to the desired geometrical final shape, usually a parallelepiped.

The problem with the abovementioned packages has always been the difficulty associated with creating an opening arrangement which is comfortable to handle and which functions satisfactorily, that is to say which can be opened readily without the use of a tool and which allows emptying of the contents in a uniform and well-defined jet.

One type of known opening arrangements up to now consisted of some form of perforation which extends through the outer plastic layer of the packing container and the carrier layer, whereas the inner plastic layer of the packing container is kept intact. The demand made on such an opening arrangement certainly is that it should be easy to tear the perforation when the package is to be opened, but the perforation should not be liable to be torn up during normal handling and transport of the package. It will be readily understood that these two demands are difficult to meet at the same time, since avoidance of inadvertent opening of the perforation during handling of the package implies that the perforation should not weaken the package wall to an excessive degree, which in turn means that greater force will be needed for tearing open the perforation when the package is to be opened. It also has been found that perforations of this kind may give rise to small leakages, which perhaps are not so great as to allow the contents to escape, but are still large enough to enable bacteria to penetrate and infect the contents of the package.

A somewhat more readily openable package is that which has been provided with an opening arrangement of the tearing strip (so-called pull-tab) type, Such an opening arrangement usually comprises a hole punched out in the container wall which is closed with the help of a tearing strip attached to the outside of the container wall and which is sealed to a plastic film covering the hole from underneath. The plastic film usually consists of the inner plastic coating of the packing material, but may be a separate plastic strip which has been sealed to the inside of the container wall along a liquid-tight sealing joint round the whole opening contour of the hole. Such packing containers are opened in that the tearing strip with the help of a readily grippable pull-tab or pull-ring is pulled upwards and backwards over the hole, as a result of which the firmly sealed plastic film, covering the hole from underneath, is stretched and torn off against the cut edge of the hole to expose a corresponding pouring opening through which the contents of the package can be emptied.

An opening arrangement similar to that described above is as a general rule easy to open, but the ability the contents to be poured in a desired coherent and well-directed jet is impaired by the fact that the plastic film adhering to the inside of the package often produces a somewhat uneven or frayed tearing edge around the pouring opening. One of the causes of the uneven tearing edge is that it is difficult to carry out the seal between the tearing strip and the plastic film in the area closest to the cut edge of the opening which means that as the outer tearing strip is pulled away, the plastic film is stretched and breaks sooner within this poorly sealed region than against the cut edge of the opening. A futher problem with this type of opening arrangement is that the plastic film torn away within the opening region exposes the cut edge of the opening so that the contents come into contact with, and are absorbed by, the cut edge during the pouring.

OBJECTS AND SUMMARY OF THE INVENTION

It is an object of the present invention, therefore, to provide an opening arrangement in which the inconveniences of known opening arrangements described above can be completely eliminated.

This object is achieved in accordance with the present invention in that an opening arrangement of the kind described in the introduction is provided with a material strip that covers the top and that is firmly attached to the container wall by means of a projection which extends from the underside of the strip and which is accomodated in the hole. The material strip has free end that is folded over and around the cut edge of the hole and is that sealed to the inside of the container wall in a liquid-tight and mechanically strong sealing joint around the whole opening contour of the hole. The other end of the strip is bent over the hole and is sealed to the one end of the strip within a sealing region which comprises a least a part of the underlying opening part capable of being torn away. The strip is provided with a readily grippable pull-ring or pull-tab to facilitate backwards bending of the other end of the strip while tearing away at the same time the opening part of the strip so as to exposee a corresponding pouring opening.

The openable part of the strip preferably includes an integrated material portion of reduced thickness within the region of the downwards directed projection.

From a point of view of the consumer it is often the wish to allow reclosure of an opened, partially emptied, packing container so as to provide at least some protection for the contents of the container until the next occasion of emptying. This wish too is met with the help of the opening arrangement proposed in accordance with the invention, in that in accordance with a further embodiment, the main part of the other end of the strip, which preferably is connected with the one end of the strip by means of a flexible intermediate piece serving as a bending hinge, is of a cup-shaped design open towards the top with a plane base and an upright unbroken side wall. The side wall is shaped and dimensioned so that it can accurately fit the boundary edge of the pouring opening and so that, it can be pressed down into, and reatined in, the opening.

a secure reclosure is obtained in accordance with the invention by providing the side wall with an outer, unbroken, compressible bulge which is adapted so that on reclosure it can engage in a radially inwardly directed shoulder formed in the projection accomodated in the hole in order to retain the cup-shaped strip end in the restored, pressed-down reclosure position.

To improve further the pouring properties of a packing container which has been provided with an opening arrangement in accordance with the invention, the strip may have a pouring edge designed as a prolongation of the one end of the strip in the intended ouring direction which extends up to, or projects slightly out over, a boundary edge of the container wall provided with the hole.

In accordance with a very simple embodiment of the invention, but one which functions well in practice, the material strip can be fabricated from a coherent ninjection-moulded) piece of polythene or a similar weldable or heat-sealable thermoplastic material, e.g. polypropylene. Such an integral plastic strip is both easy to manufacture and to apply and can be fabricated, moreover, in large scale manufacturing and material production at low costs.

BRIEF DESCRIPTION OF THE DRAWINGS

The invention will be described and explained in detail with reference to the attached drawings wherein like elements bear like reference numerals and wherein

FIGS. 1–3 depict, in cross-section, an upper corner region of a packing container 1 provided with an opening arrangement in accordance with the invention. The container 1, for example, may be a conventional parallelepipedic, so-called non-returnable, package with four vertical side walls 2 situated oppositely in pairs and an upper and a lower substantially plane end wall 3 connected to the side walls, whereof only the top one is shown in the drawing. A package of this kind is manufactured in accordance with known techniques in that a web of laminated material, customarily thermoplastic-coated paper, is converted first to a tube by joining together both axial edges of the web in a longitudinal overlap joint. The tube is filled with the intended contents and is divided into closed, cushion-shaped packing units through repeated flattenings and transverse sealings of the tube at right angles to the longitudinal axis of the tube. The packing units are separated from one another by means of cuts in the transverse seals and are given a desired parallelepipedic end shape through a further forming and sealing operation during which double-walled, triangular corner lugs of the packing units are folded inwardly against, and sealed to, the outside of packages.

Figure 1:
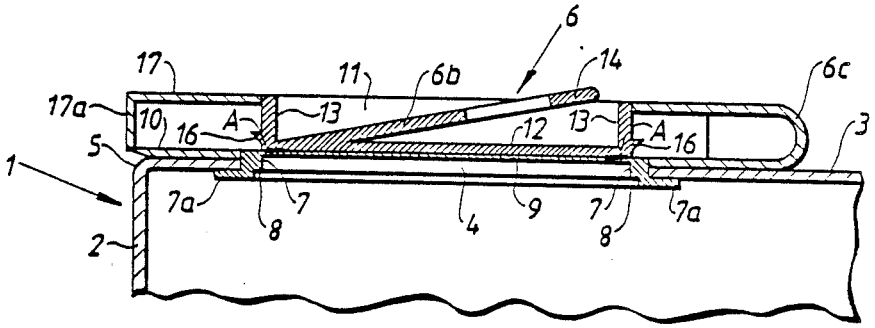
FIG. 1 is a cross-sectional view of a portion of a closed packing container provided with an opening arrangement in accordance with the invention.

The package 1 has a hole 4 punched out in its upper end wall 3, located at one of the corner regions of the end wall adjoining a boundary edge 5 between the end wall and a neighbouring side wall 2. The shape and size of the hole 4 are not critical according to the invention, but may vary in each instance to suit the actual contents of the package.

The hole 4 is covered from above by the opening arrangement in accordance with the invention which in the embodiment shown includes a material strip 6 attached to the outside of the container wall 3. The two ends 6*a* and 6*b* of the material strip 6 are connected with one another by a flexible intermediate piece 6*c* which serves as a bending hinge. The strip 6 is preferably fabricated from a coherent, injection-moulded thermoplastic piece of polyethylene or a heat-sealable plastic material similar to the thermoplastic coatings of the packing material.

As is evident from the Figures, the one end 6*a* of the strip (i.e., the first part) has a downwardly directed projection 7 accomodated in the hole 4 that is shaped and dimensioned to provide a good fit with respect to the cut edge of the hole. The free end 7*a* of the projection 7 is folded around the cut edge and is sealed to the inside of the container wall 3 around the whole contour of the hole to provide a liquid-tight and mechanically strrong sealing joint and to ensure that the strip 6 is securely fastened to the container wall. The projection 7, moreover, has a shoulder 8 directed radially inwardly which delimits a portion 9 of reduced material thickness, situated wholly within the region of the hole, and which is adapted so that it can be torn away to form a corresponding pouring opening through which the contents of the package are made accessible. This thickness-reduced material portion 9 preferably is designed so that the pouring opening formed is given an optimum shape for the particular contents.

As is evident, the strip 6 has a pouring edge 10 in the shape of a prolongation of the one end 6*a* of the strip in the intended pouring direction of the contents, which extends up to, or projects slightly out over, the boundary edge 5 of the container wall 3 provided with the hole to facilitate the pouring out of the contents of the package and thereby improve the pouring properties of the package. The pouring properties are improved further in that the strip 6 is provided with vertical lateral edges or banks 11 along the longitudinal edges of the one end 6a. The lateral edges or banks 11, which extend up to the outermost end of the pouring edge help to guide and collect the contents poured out to a concentrated flow towards the pouring edge from where they leave the package in a drip-free, well-directed, coherent jet.

The other end 6b of the strip (i.e., the second part), which is bent forwards over the hole 4, is of a substantially cup-shaped design with a base 12 and surrounding upright side walls 13. The base is bent to rest flat against the thickness-reduced material portion of the one end of the strip and is sealed to this portion along a region A which follows the whole boundary line of the thickness-reduced portion. At the other end 6b of the strip there is, furthermore a grip-ring 14 projecting from the base 12 and situated almost completely within the region of the side walls 13 of the cup-shaped formation which is adapted so as to facilitate backwards pulling of the second strip end 6b on opening of the package 1.

To make possible a reclosure of the package 1 the cup-shaped strip end 6b is shaped and dimensioned so that it can be pressed down into, and with a good fit against, the remaining tearing edge 15 after the torn-away, thickness-reduced material portion 9 is retained in the torn-up pouring opening. To improve further the retention of the strip end thus pressed down, the side walls 13 are provided with an outer, all-around, compressible bulge 16 which is adapted so that it can be engaged under the shoulder 8. The strip 6 finally is provided with an L-shaped section 17 projecting from the top edge of the front wall 13 for the protedction of the pouring edge 10 on the underlying strip end 6a. The profile 17 is dimensioned so that the front leg 17a directed downwards is able to surround an outer end of the pouring edge 10 when the cup-shaped strip end 6b is pressed down into the pouring opening when the package is reclosed.

Figure 2:
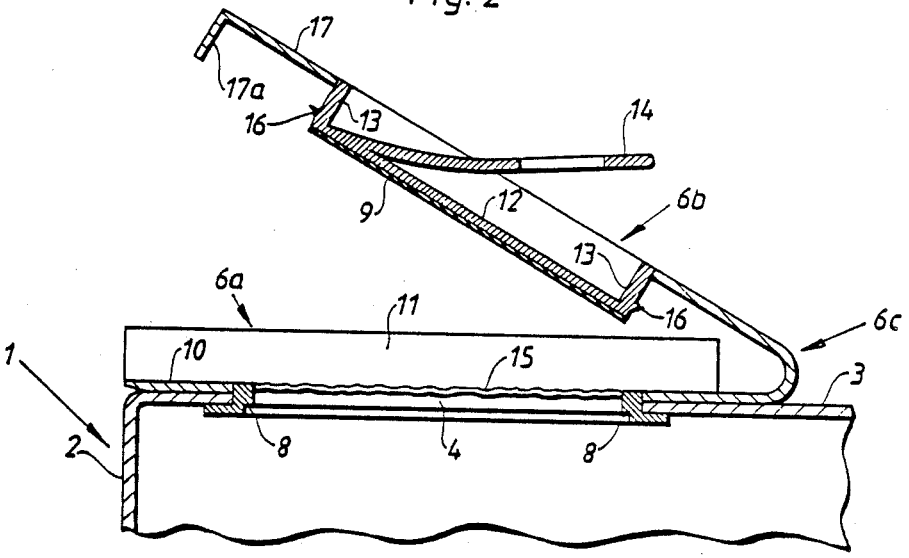
FIG. 2 is a cross-sectional view similar to FIG. 1 with the opening arrangement in the opened position.

When the package shown in FIG. 1 in closed position is to be opened, the grip-ring 14 is grasped and pulled backwards and upwards to the position shown in FIG. 2, whereby the thickness-reduced material portion 9 is torn away over the hole 4 along its boundary line and adheres to the base 12 of the strip end pulled backwards so as to expose a corresponding access opening for the contents of the package.

Figure 3:
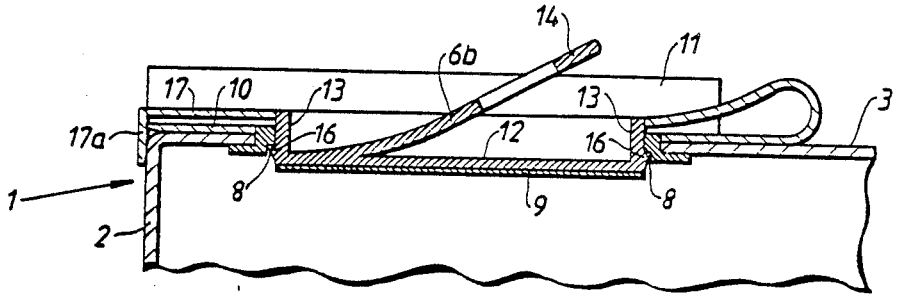
FIG. 3 is a cross-sectional view with the opening arrangement in the fully reclosed position.

When the opened package is to be reclosed, the backwardly bent strip end 6b is that forwards and is pressed down into the pouring opening. The bulge 16 on the side walls 13 of the cup-shaped formation engages the shoulder 8 and retains the strip end pressed downwards in the reclosure position shown in FIG. 3.

While this invention has been illustrated and described in accordance with a preferred embodiment, it is recognized that variations and changes may be made and equivalents employed herein without departing from the invention as set forth in the claims.

We claim:

1. A reclosable opening arrangement for a packing container comprising:

a container wall having an opening and an insert secured in said opening, said insert having a central portion of reduced thickness;

a flexible strip having first and second parts, said first part being secured to said container wall adjacent said opening and said second part being superimposed over said opening, a cap secured on said second part and having a base and a surrounding upright side wall, said centrally lcoated portion of reduced thickness being secured to the base of the cap, and gripping means on said cap for pulling said cap away from said container wall to remove said central portion to expose a hole in said insert through which the contents of said container may be poured.

2. The opening arrangement according to claim 1, therein said first and second parts are connected by a flexible intermediate piece.

3. The opening arrangement according to claim 1, including a compressible bulge attached to and extending radially outwardly from an outer circumferential surface of the side wall, said projection being hollow and having a shoulder located on an inner surface thereof so that said cap can be positioned inside the projection and retained in place with the bulge engaging the shoulder.

4. The opening arrangement according to claim 1, wherein said first part of said strip has a pouring edge which is adapted to extend at least up to an outer edge of the wall of the container to which the arrangement is attached.

5. The spring arrangement according to claim 4, wherein said second part of said strip has a substantially L-shaped extension extending from said side wall for protecting said pouring edge, said L-shaped extension having a front leg that surrounds said pouring edge when the cap is pressed down into the projection.

6. The opening arrangement according to claim 4, including upstanding lateral walls attached to longitudinal edges of the first part, said lateral walls extending as far as the pouring edge so that said lateral walls in combination with said pouring edge define a guide for guiding the contents of the container as the contents are emptied from the container.

7. The opening arrangement according to claim 1, wherein said insert includes a radially outwardly directed flange that surrounds the opening and that is sealed to an inner surface of the container wall.

8. In a packing container having a hole extending through a wall in the container for emptying contents of the container, a reclosable opening arrangement comprising:

a flexible strip having first and second parts that are connected by a flaxible intermediate piece, said first part having a projection extending therefrom with a flange connected to and extending radially outwardly from the projection, said projection being positioned in the hole in the container wall so that said flange surrounds the hole and said flange being sealed to an inner surface of the container wall in a liquid-tight manner, said first part including a central portion of reduced thickness, said second part being cup-shaped and having a base and a surrounding upright side wall, a bottom surface of the base being secured to a top surface of the central portion of reduced thickness, and a grip-ring attached to and extending from a top surface of the base for pulling said cup-shaped second part away from said container wall to remove said central portion and thereby expose a hole in said projection through which the contents of said container may be poured, said flexible strip including means for permitting the cup-shaped second part to be retained within the projection after the central portion has been removed and the cup-shaped second part has been pushed into the projection.

9. A packing container according to claim 8, wherein said packing container is fabricated from thermoplastic-coated paper and said flexible strip is fabricated from heat-sealable material, the flange extending from the projection being heat-sealed to the inside of the container wall.

10. A packing container according to claim 8, wherein said means for permitting the cup-shaped second part to be retained in the projection includes a compressible bulge attached to and extending radially outwardly from an outer circumferential surface of the upright side wall and said projection being hollow and having a shoulder located on an inner surface thereof so that said cup-shaped second part can be pressed down into the projection and retained in place through engagement of the bulge with the shoulder.

11. A packing container according to claim 9, wherein said first part of said strip has a pouring edge which extends outwardly at least as far as an outer edge of the wall of the container to which the arrangement is attached.

12. A packing container according to claim 11, including upstanding lateral walls attached to longitudinal edges of said first part, said lateral walls extending as far as the pouring edge so that said lateral walls in combination with said pouring edge define a guide for guiding the contents of the container as the contents are emptied from the container.

13. A packing container according to claim 11, including a substantially L-shaped extension extending from said side wall of the cup-shaped second part for protecting the pouring edge, said L-shaped extension having a front leg that surrounds said pouring edge when the second part is pressed down into the projection.

* * * * *

UNITED STATES PATENT AND TRADEMARK OFFICE

CERTIFICATE OF CORRECTION

PATENT NO. : 4,986,465

DATED : January 22, 1991

INVENTOR(S) : Kent Jacobsson, et al.

It is certified that error appears in the above-identified patent and that said Letters Patent is hereby corrected as shown below:

On the title page, item [73] should read as follows:

--[73] Assignee: Tetra Pak Holdings & Finance S.A., Pully, Switzerland--.

Signed and Sealed this

Fourteenth Day of July, 1992

*Attest:*

DOUGLAS B. COMER

*Attesting Officer*

*Acting Commissioner of Patents and Trademarks*